United States Patent [19]

Komaki

[11] 4,293,754

[45] Oct. 6, 1981

[54] THIN AND FLAT KEYBOARD INTEGRAL WITH A METALLIC HOUSING

[75] Inventor: Shigeki Komaki, Nara, Japan

[73] Assignee: Sharp Kabushiki Kaisha, Osaka, Japan

[21] Appl. No.: 107,888

[22] Filed: Dec. 28, 1979

[30] Foreign Application Priority Data

Dec. 28, 1978 [JP] Japan ..... 53-179785[U]

[51] Int. Cl.[3] ..... H01H 3/12

[52] U.S. Cl. ..... 200/340; 200/159 B; 200/5 A

[58] Field of Search ..... 200/5 A, 5 R, 5 E, 5 D, 200/159 R, 159 A, 159 B, 340; 235/145 R

[56] References Cited

U.S. PATENT DOCUMENTS 3,290,439 12/1966 Willcox et al. ..... 200/5 A
3,627,935 12/1971 Spievak ..... 200/340
3,979,568 9/1976 Johnson ..... 200/159 B
4,066,860 1/1978 Kawasaki ..... 200/159 A
4,160,886 7/1979 Wright ..... 200/5 A

FOREIGN PATENT DOCUMENTS 2459464 6/1975 Fed. Rep. of Germany ..... 200/340

*Primary Examiner*—John W. Shepperd
*Attorney, Agent, or Firm*—Birch, Stewart, Kolasch & Birch

[57] ABSTRACT

A keyboard construction including a metallic flat housing member and a metallic flat key actuator member closely laid upon the metallic flat housing member. The former has apertures in positions to correspond to respective ones of key actuator sections while the latter has cutouts to make respective ones of key actuators formed therein movable in a vertical direction. Key indicia are defined on the tops of the respective key actuators during the etching of the two members.

3 Claims, 7 Drawing Figures

THIN AND FLAT KEYBOARD INTEGRAL WITH A METALLIC HOUSING

SUMMARY AND BACKGROUND OF THE INVENTION

This invention relates to a thin and flat keyboard structure.

As disclosed in earlier applications Nos. 16,075 on Feb. 28, 1979 and 33,414 on Apr. 14, 1979 both entitled METALIC HOUSING FOR AN ELECTRONIC APPARATUS WITH A FLAT KEYBOARD, the applicant of this application has proposed a new type of a keyboard which takes advantage of part of an upper member of a housing as key actuators or key tops. Cutouts are each formed around the whole periphery of a respective one of limited areas of a housing member except for a hinge section, the respective limited areas defined by the cutouts behaving as the key actuators. Since the housing member and the key actuators are both made from the same material and it is difficult to work the key actuators independently of the housing member, the above mentioned attempts are still unsatisfactory in that neither distinction between the key actuators and the housing member nor the positions of the key actuators itself are ambiguous and an objectionable gap occurs between the housing member and the key actuators, thus presenting the possibility that the edges of the key actuators may be scratched by the operator's finger and sometimes become warped in the upward direction. The suggested keyboard in which the hinge sections remain is of a practical advantage in that the key actuators may be integral with the housing member but has difficulty in obtaining an appropriate key load in view of the necessary strength of the housing, etc.

Accordingly, it is an object of the present invention to provide an improvement in the earlier filed keyboards in which two metallic sheets with a very thin thickness are employed to constitute an upper member of the housing and the key actuators.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
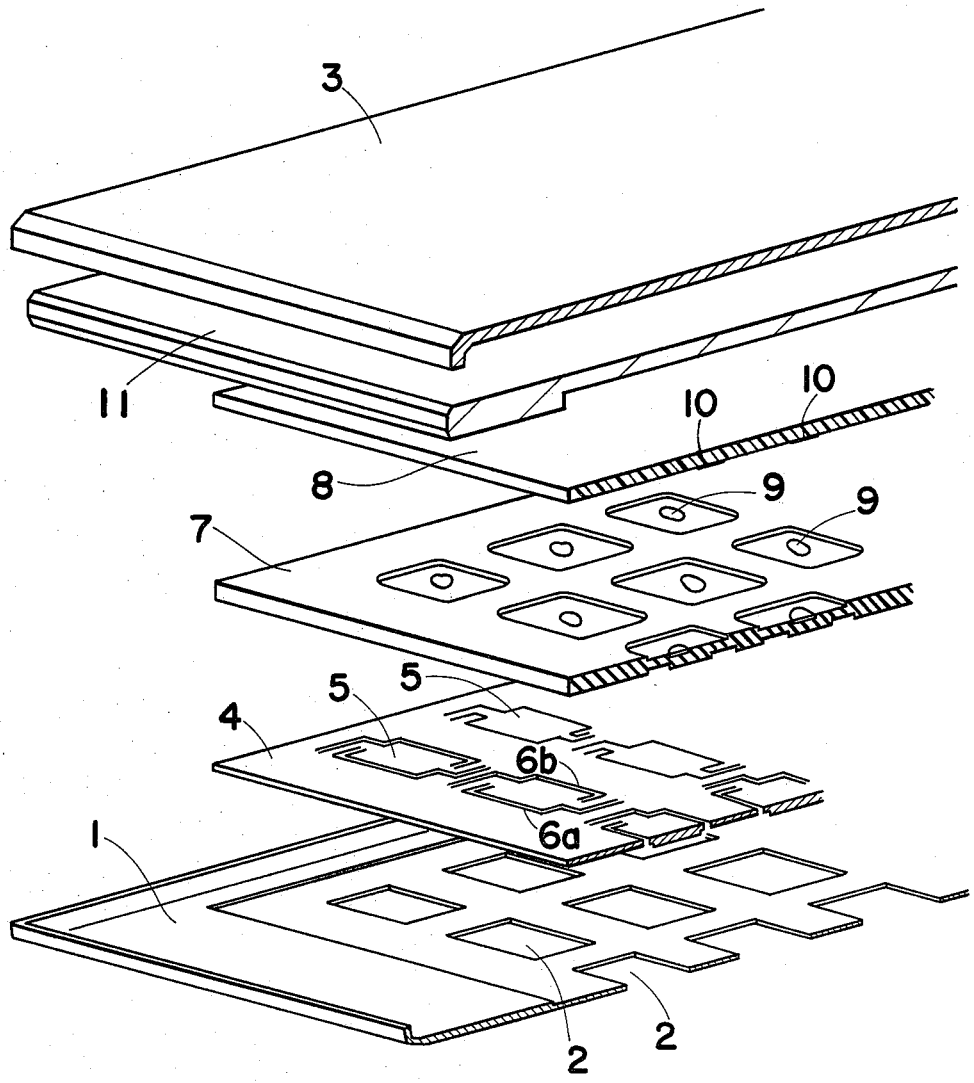
FIG. 1 is an exploded perspective view, partially in section, of one preferred form of the present invention.
Figure 2:
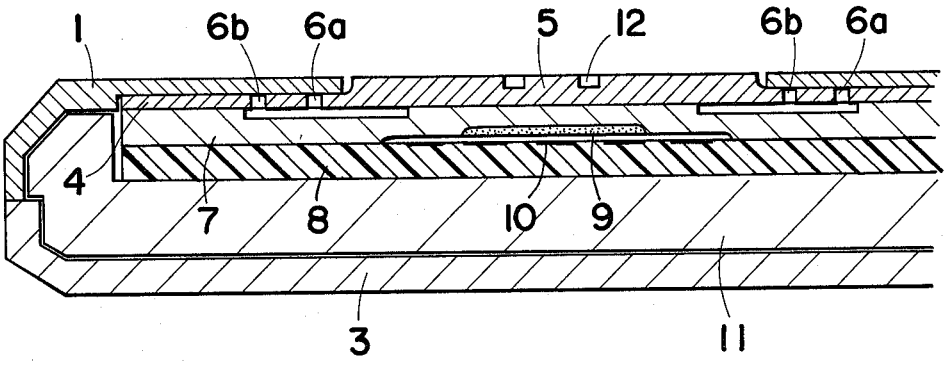
FIG. 2 is a perspective view of how to assemble the components shown in FIG. 1.

Referring now to FIGS. 1 and 2, there are shown an exploded perspective view and a cross sectional view illustrating one preferred form of the present invention when applied to a hand-held calculator. An upper member 1 of the housing is made from a metal such as stainless steel and aluminum and has apertures 2 each corresponding to a respective one of the key actuators. A lower member 3 of the housing is likewise made of metal. A key actuator sheet 4 is also made from a metal material and more preferably a highly flexible metallic sheet such as stainless steel and phospher bronze. The respective key actuators 5 are made integral with the key actuator sheet 4 and are defined by cutouts **6*a*, 6*b*, etc. When the upper member 1 of housing is stacked on the key actuator sheet 4, the upper faces of the respective key actuators are exposed to the outside world through the apertures. A key contact rubber sheet 7 and a key circuit board 8 carry opposing key contacts 9 and 10. A pressure plate 11 is provided to urge the key circuit board 8 against the upper member 1 of housing together with the key actuator sheet 4 and the key contact rubber sheet 7 as well as serving as a reinforcing member for the hand-held calculator. In FIG. 2, key indicia formed on the tops of the key actuators 5 are labeled 12**.

Figure 4:
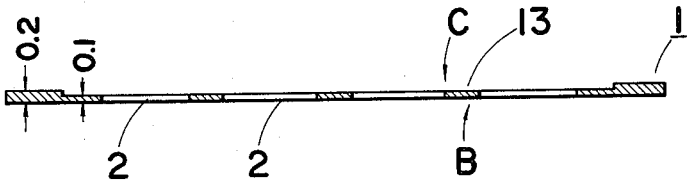
FIG. 4 is a cross sectional view taken along the line A—A of FIG. 3.
Figure 3:
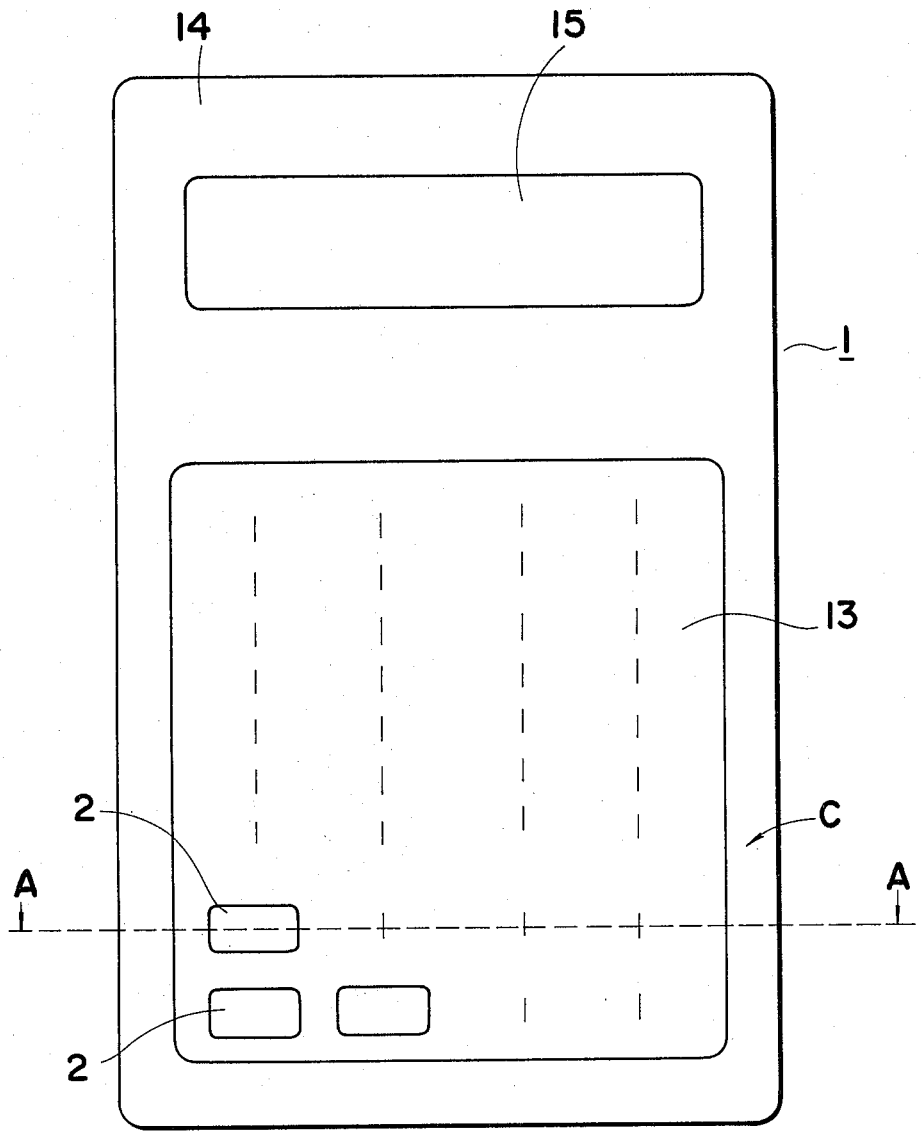
FIG. 3 is a rear view of an upper member of the housing.

Details of the upper member 1 of the housing are illustrated in FIGS. 3 and 4 with the former being a rear view and the latter being a cross sectional view taken along the line A—A of FIG. 3. As stated briefly above, the upper member 1 of housing is made of a stainless steel sheet of 0.2 mm thick and subject to various processes such as etching. Key actuator sections 13 (corresponding to the key actuators sheet 4 when being stacked) are concave shaped with a thickness of 0.1 mm and has a predetermined number of the apertures 2 formed therein. A thick thickness section 14 is provided with a viewing window 15 for a display, for example, a liquid crystal display cell.

The whole top surface (the surface B in FIG. 4) of the upper member of the housing is coated with a layer of etching resist material except for the apertures 2 and the viewing window 15. The rear surface (FIGS. 3 and 4C) is also overlaid with a layer of etching resist material except for the corresponding key actuator sections 14 and the viewing window 15. Both the top and bottom surfaces are subjected to etching up to a depth of 0.1 mm. After the removal of the etching resist material the upper member 1 of the housing, as discussed above, results.

Figure 5:
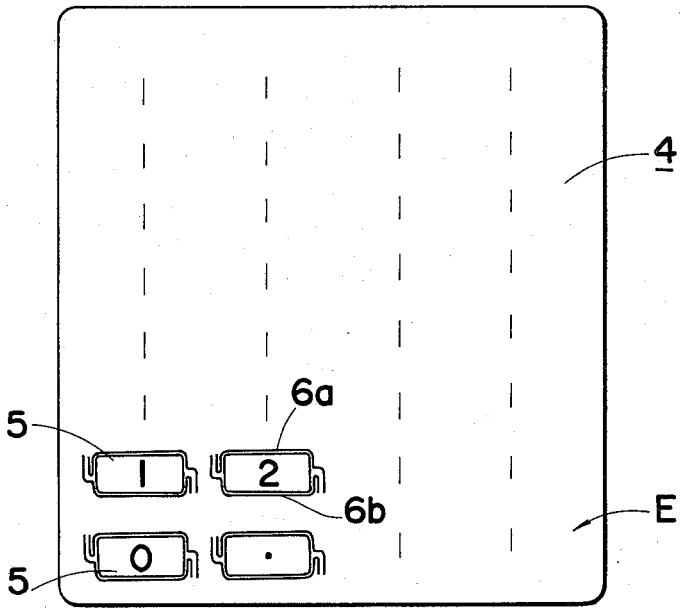
FIG. 5 is a front view of an integral key actuator sheet.
Figure 6:
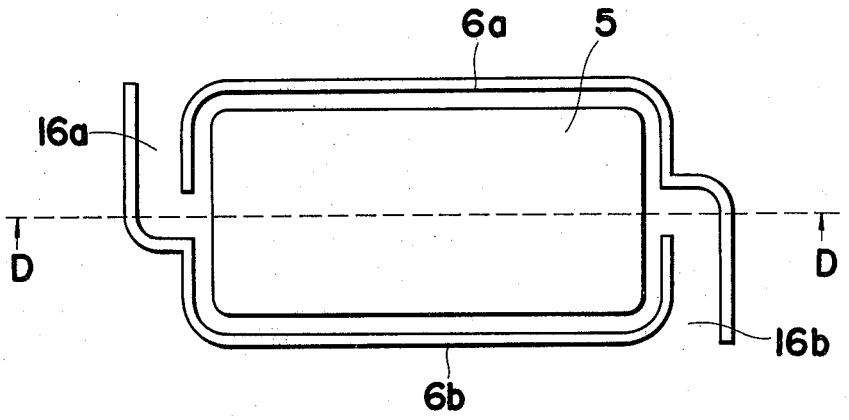
FIG. 6 is a partly enlarged cross sectional view of FIG. 5.
Figure 7:
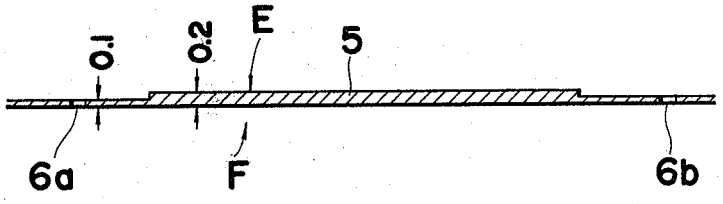
FIG. 7 is a cross-sectional view taken along the line D—D of FIG. 6.

Details of the key actuator sheet 4 are depicted in FIGS. 5 through 7 wherein FIG. 5 is a front view, FIG. 6 is an enlarged view of the key actuator 5 with two cutouts **6*a* and 6*b* and FIG. 7 is a cross-sectional view taken along the line D—D of FIG. 6. As stated above, the key actuator sheet 4 is made from, for example, a phosphor bronze sheet of 0.2 mm thick and subjected to various processes such as etching. The key actuator section 5 is 0.2 mm thick and all of remaining sections are substantially 0.1 mm thick so that the former is convex as a whole and surrounded by the cutouts 6*a* and 6*b*. The cutouts 6*a* and 6*b*, as viewed from FIG. 6, are not contiguous to each other and thus establish key actuator supports 16*a* and 16*b* of a given length along the length of the key actuator 5. The key actuator 5 may be thus made integral with the key actuator sheet 4** and given flexibility to reduce load when being actuated, so that the key actuator is movable upward and downward without tilting itself.

One way of manufacturing the above described keyboard will be discussed below. The key actuator section 5 at the front face (the surface E in FIGS. 5 and 7) of the metallic sheet is first covered with the etching resist layer while the rear face thereof is covered with the same etching resist layer wholly except for the cutouts 6*a* and 6*b*.

Etching is allowed to progress up to a depth of 0.1 mm. The subsequent removal of the front and rear etching resist layers results in the above illustrated key actuator sheet 4. When it is desired to define key actuator indicia 12 by etching, the portion of the etching resist layer corresponding to these indicia should remain for printing.

If the resulting upper member 1 of the housing is laid upon the key actuator sheet 4, they both look like a single metallic sheet in the aggregate as viewed from FIG. 2. In this case, when the both elements are made of a different in material (in the above illustrated example, stainless steel and phospherus bronze), they can be distinguished in color, etc. from each other and the respective positions of the key actuators are clear. Although not shown in the drawings, it is obvious that it is possible to treat the respective surfaces differently with grinding or otherwise to distinguish the surface states between both of the elements and make the respective positions of the key actuators clear, even when the upper member of the housing and the key actuators are made from the same material, for example, stainless steel. Moreover, since the key actuator sheet member 4 is distinct and separate from the upper member 1 of housing, it is also possible to implement the former with a highly flexible metallic sheet without reducing the overall strength of the keyboard construction. The cutouts 6*a* and 6*b* are concealed behind the bottom of the upper member 1 of the housing without imparing the appearance of the keyboard construction. This makes it possible to form the cutouts in any desired pattern, assure an optimum load when a key is actuated, prevent the edges of the key actuators from being scratched by the operator's finger and becoming warped in the upward direction and reduce the spacing between the key actuators and the upper member 1 of the housing to a minimum.

Otherwise, in the case where the upper member 1 of the housing and the key actuator member 5 are made from a metallic sheet, the resulting keyboard construction becomes tough and thin as well as serving as an electrostatic shield. Key indicia may be printed by etching at the time the cutouts are formed in the metallic sheets.

Whereas the present invention has been described with respect to specific embodiments thereof, it will be understood that various changes and modifications will be suggested to one skilled in the art, and it is intended to encompass such changes and modifications as fall within the scope of the appended claims.

I claim:

1. A thin keyboard construction for a handheld calculator which comprises a housing member and a key actuator sheet containing a plurality of key actuators which are integral with said key actuator sheet, said housing member being made of a sheetlike flat material having a portion of its area with a reduced thickness, said key actuator sheet being disposed in said area of reduced thickness, said area of reduced thickness having apertures disposed therein in positions corresponding to said plurality of key actuators, said key actuator sheet being made of a sheet like flat material having cutout portions defining said plurality of key actuators, said cutout portions enabling said key actuator to move in a vertical direction, and said cutout portions being concealed behind said housing member.

2. A keyboard construction according to claim 1 wherein said housing member and said key actuator sheet are made of a metallic material.

3. A keyboard construction according to claim 1 wherein key indicia are formed on the tops of said key actuators.

* * * * *